US007160152B2

(12) United States Patent
Tsai

(10) Patent No.: US 7,160,152 B2
(45) Date of Patent: Jan. 9, 2007

(54) ELECTRICAL CONNECTOR HAVING A METAL HOUSING

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/394,617

(22) Filed: Mar. 31, 2006

(65) Prior Publication Data

US 2006/0228945 A1 Oct. 12, 2006

(51) Int. Cl.
*H01R 13/648* (2006.01)

(52) U.S. Cl. ..... 439/607
(58) Field of Classification Search ..... 439/607

See application file for complete search history.

(56) References Cited

U.S. PATENT DOCUMENTS 6,503,102 B1 * 1/2003 Zhang et al. ..... 439/607

* cited by examiner

*Primary Examiner*—Javaid H. Nasri
(74) *Attorney, Agent, or Firm*—Pro-Techtor Int'l Services

(57) ABSTRACT

An electrical connector includes a plastic base on which one connection space is formed, terminals disposed in the plastic base, and a metal housing covering the plastic base and having one surface formed with an opening through which the connection space is exposed. The metal housing includes a main body and an upper cover. The main body is fixed to the plastic base and has a front surface, two side surfaces and an upper edge formed with one upward fixing piece having one elastic locking piece. The upper cover has downward connection flanges formed on two sides. An inner surface of each flange corresponding to the elastic locking piece is formed with an engaging slot. The upper cover covers the upper edge. The flanges are connected to and located outside the fixing piece, and engage with the elastic locking piece through the engaging slot.

12 Claims, 12 Drawing Sheets

ELECTRICAL CONNECTOR HAVING A METAL HOUSING

BACKGROUND OF THE INVENTION

1. Field of the Invention

The invention relates to an electrical connector, and more particularly to an electrical connector with a metal housing.

2. Description of the Related Art

Referring to FIG. 1, a first conventional multi-jack electrical connector includes a plastic base 10 and a metal housing 20. A plurality of terminals is disposed in the plastic base 10. A front end of the plastic base 10 is formed with three connection holes 11. The metal housing 20 covers the plastic base 10 and is integrally formed with a top surface 21, a front surface 22, a rear surface 23 and two side surfaces 24. Two sides of each of the top surface 21 and the rear surface 23 are formed with folded edges 25 and 26. The front surface 22 is formed with three openings 27 for exposing the connection holes 11 of the plastic base 10. The metal housing 20 is made by cropping a metal plate into a corresponding shape and then folding the metal plate into the metal housing with an open end.

The first prior art connector has the following drawbacks.

1. The metal housing 20 is formed by folding a plate to form a chamber, as shown in FIG. 2, so the developed shape has to be cut with a lot of wasted material.

2. The metal housing 20 is formed by folding a plate and the top surface 21 only rests against but is not integrally connected to the two side surfaces 24, so seams still exist. In order to enhance the sealing effect, the folded edges 25 are formed to cover the seams. Similarly, the seams are also formed between the rear surface 23 and the two side surfaces 24, and the folded edges 26 are also formed to cover the seams. The overlapped portions on the housing deteriorate the overall glorification.

As shown in FIGS. 3 and 4, a second conventional multi-jack electrical connector includes a plastic base 30 and a metal housing 40 and is almost the same as the first conventional connector. In order to reduce the waste of the material, the metal housing 40 is composed of a front housing 41 and a rear housing 47. The front housing 41 has a U-shape and includes a front surface 42 and two side surfaces 43. An upper portion of the front surface 42 is formed with a folded edge 44. A rear portion of each side surface 43 is formed with projecting engaging blocks 45. The rear housing 47 having an L-shape includes a top surface 48 and a rear surface 49. Two sides of the top surface 48 and the rear surface 49 are respectively formed with folded edges 410 and 411. The folded edge 411 is formed with engagement holes 412. When the front housing 41 and the rear housing 47 are assembled together, the engaging blocks 45 engage with the engagement holes 412, the folded edge 44 engages with the top surface 48 of the rear housing 47, and the folded edges 410 and 411 engage with the two side surfaces 43 of the front housing 41 and are located outside the two side surfaces 43.

Although the second conventional connector can reduce the waste of the material, it still has the drawback because the overlapped portions between the folded edges 44, 410 and 411 and the plate and the two rows of engagement holes 412 still exist on the exterior, and the glorification of the exterior is thus deteriorated.

SUMMARY OF THE INVENTION

It is therefore an object of the invention to provide an electrical connector with a metal housing, wherein the connector has an upper cover to be engaged and positioned at an upper edge of a main body having several circumferential surfaces, such that the overlapped folded edges and the engagement holes can be reduced and the exterior can be further glorified.

Another object of the invention is to provide an electrical connector having a metal housing formed using a reduced amount of material.

Still another object of the invention is to provide an electrical connector with a metal housing having a second engaging piece passing through a longitudinal slot of a first engaging piece. Thus, the first and second engaging pieces may be covered by the rear surface and the side surface of the main body such that the engaging portions may be hidden.

To achieve the above-identified objects, the invention provides an electrical connector including a plastic base on which at least one connection space is formed, a plurality of terminals disposed in the plastic base, and a metal housing, which covers the plastic base and has one surface formed with an opening through which the at least one connection space of the plastic base is exposed. Each terminal has a pin portion extending out of the plastic base. The metal housing includes a main body and an upper cover. The main body is fixed to the plastic base and has a front surface, two side surfaces and an upper edge formed with at least one upward fixing piece having at least one elastic locking piece. The upper cover has downward connection flanges formed on at least two sides. An inner surface of each of the connection flanges corresponding to the at least one elastic locking piece of the at least one upward fixing piece of the main body is formed with an engaging slot. The upper cover covers the upper edge of the main body. The connection flanges are connected to the at least one upward fixing piece and located outside the at least one upward fixing piece, and engage with the at least one elastic locking piece through the engaging slot.

According to the above-mentioned structure, the overall exterior can be glorified and the material can be saved.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
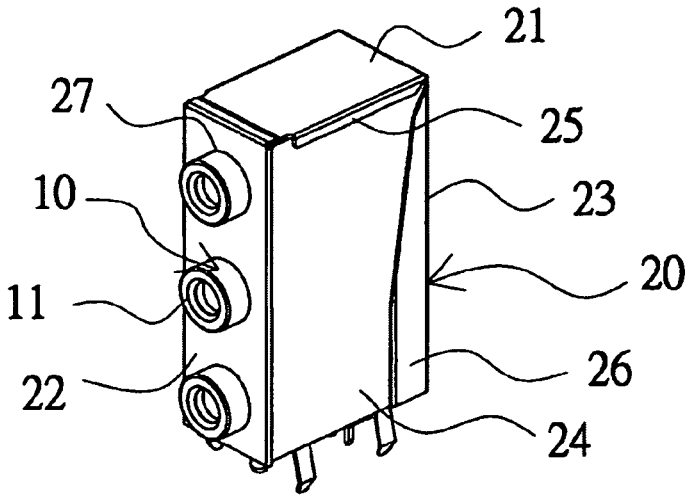
FIG. 1 (Prior Art)
FIG. 1 is a pictorial view showing a conventional multi-jack electrical connector.
Figure 2:
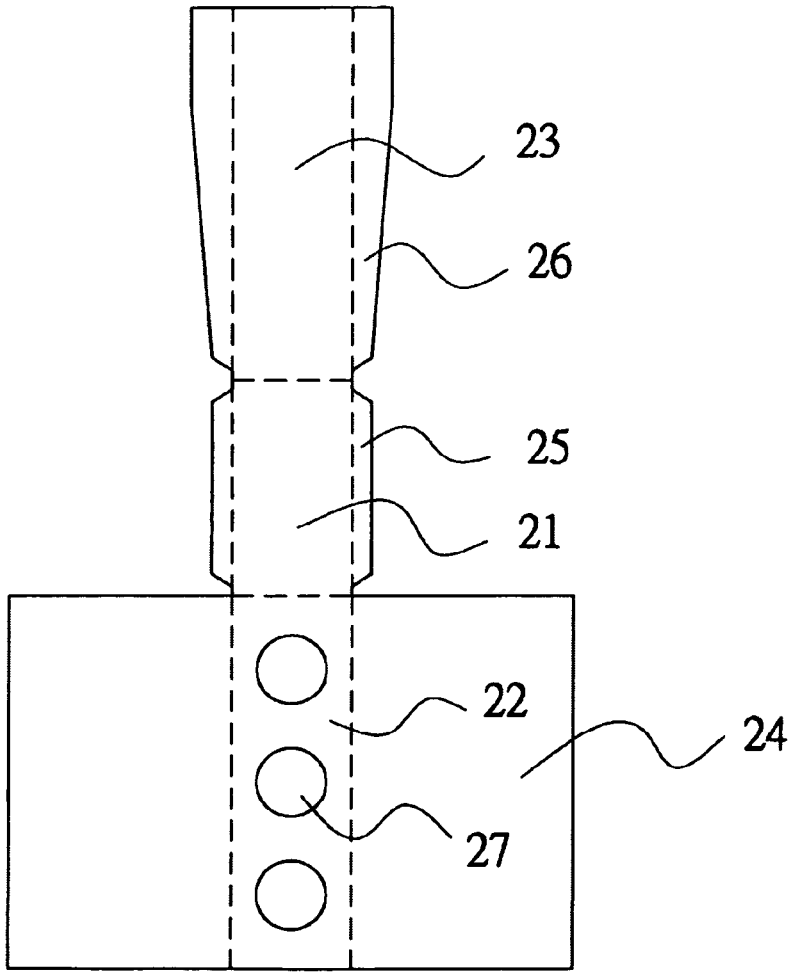
FIG. 2 (Prior Art)
FIG. 2 is a developed plane view showing a metal housing of the conventional multi-jack electrical connector.
Figure 4:
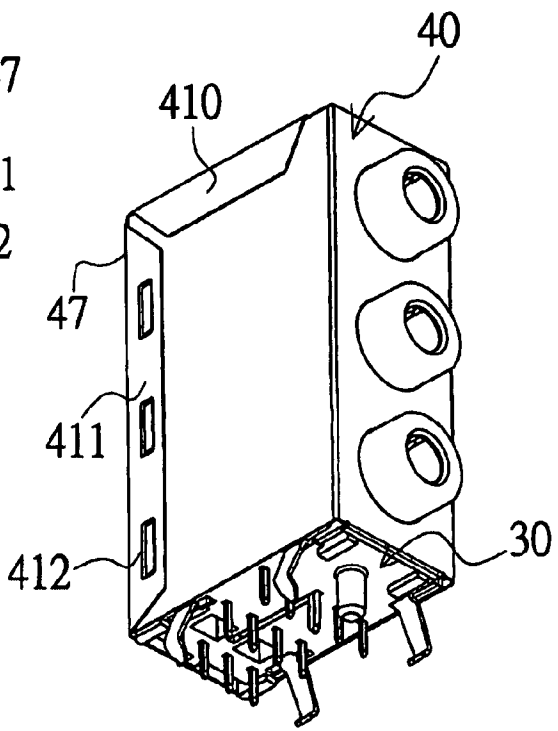
FIG. 4 (Prior Art)
FIG. 4 is a pictorially assembled view showing the conventional multi-jack electrical connector.
Figure 3:
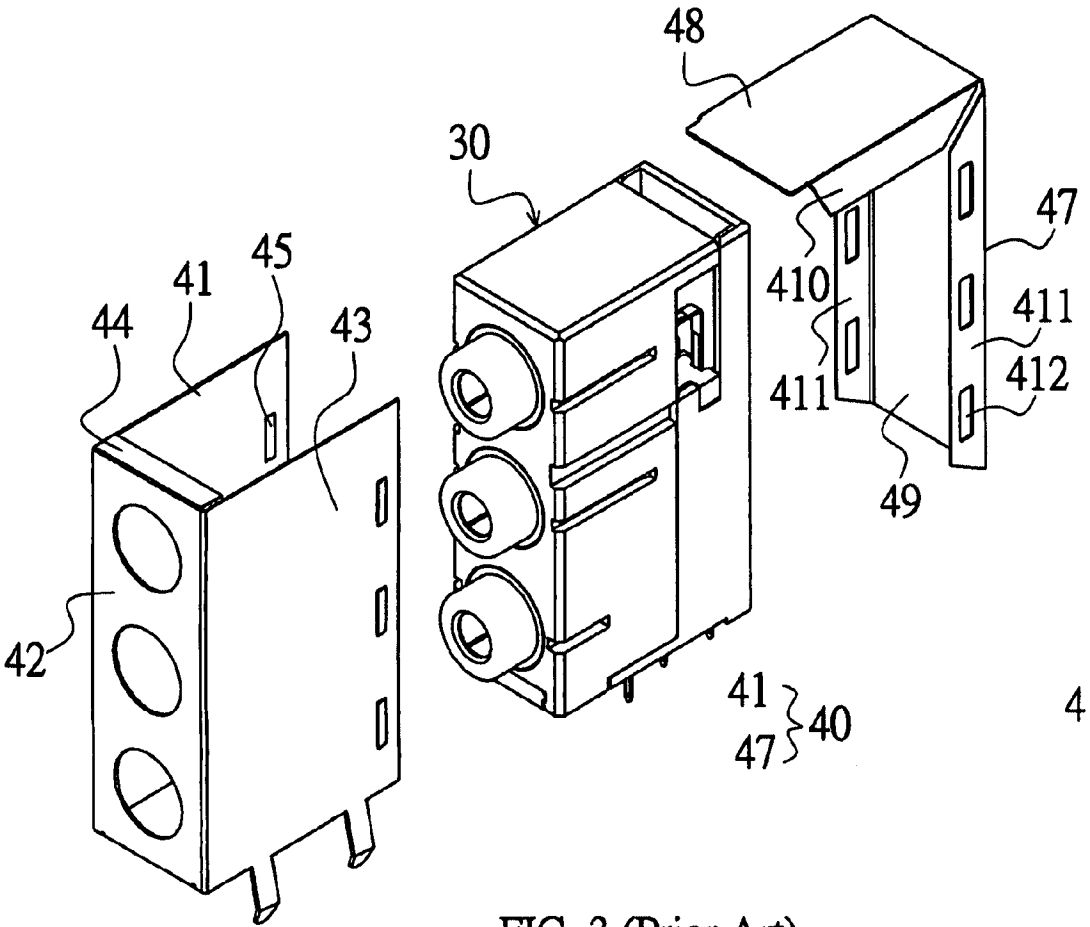
FIG. 3 (Prior Art)
FIG. 3 is a pictorially exploded view showing the conventional multi-jack electrical connector.
Figure 5:
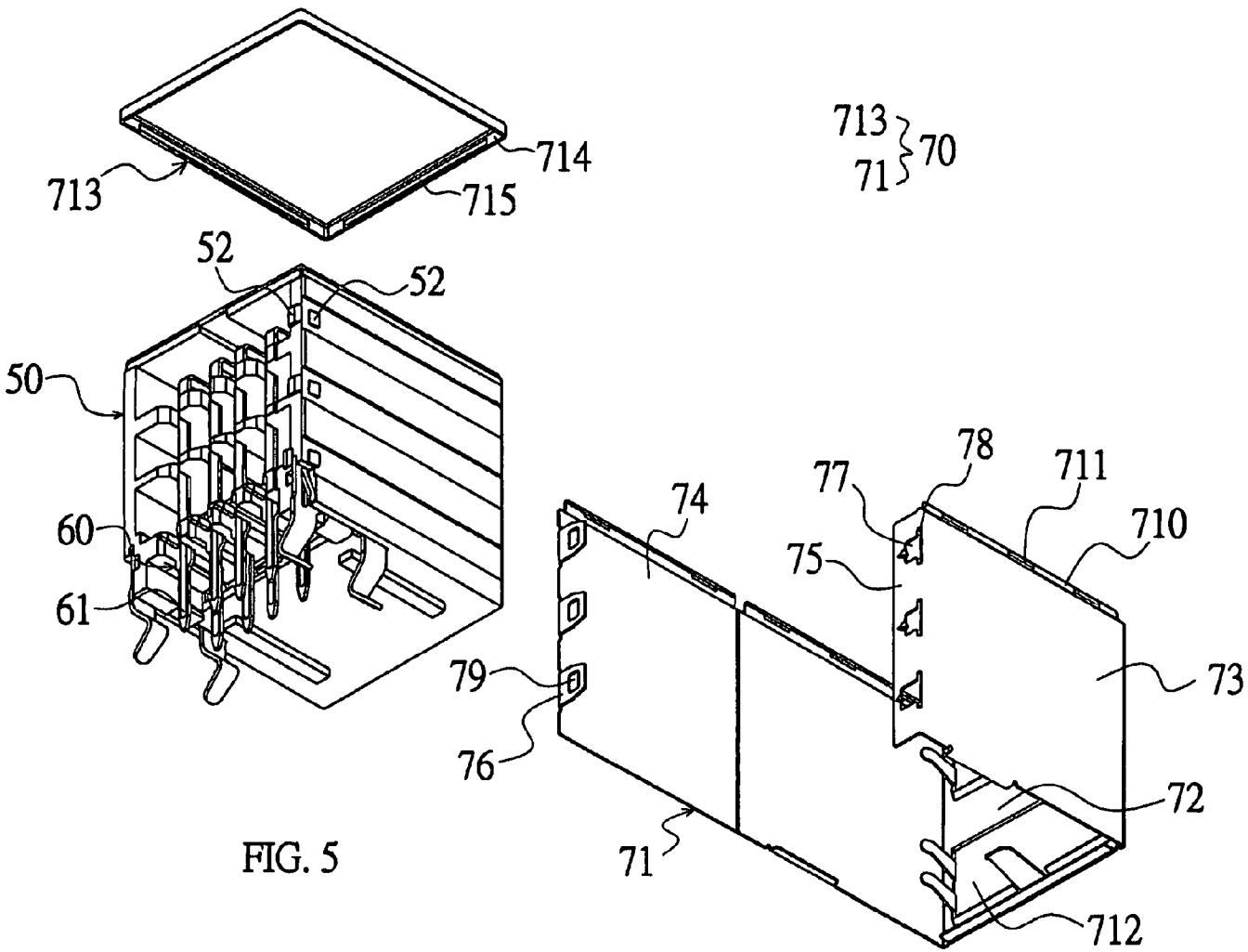
FIG. 5 is a pictorially exploded view showing an electrical connector according to a first embodiment of the invention.
Figure 6:
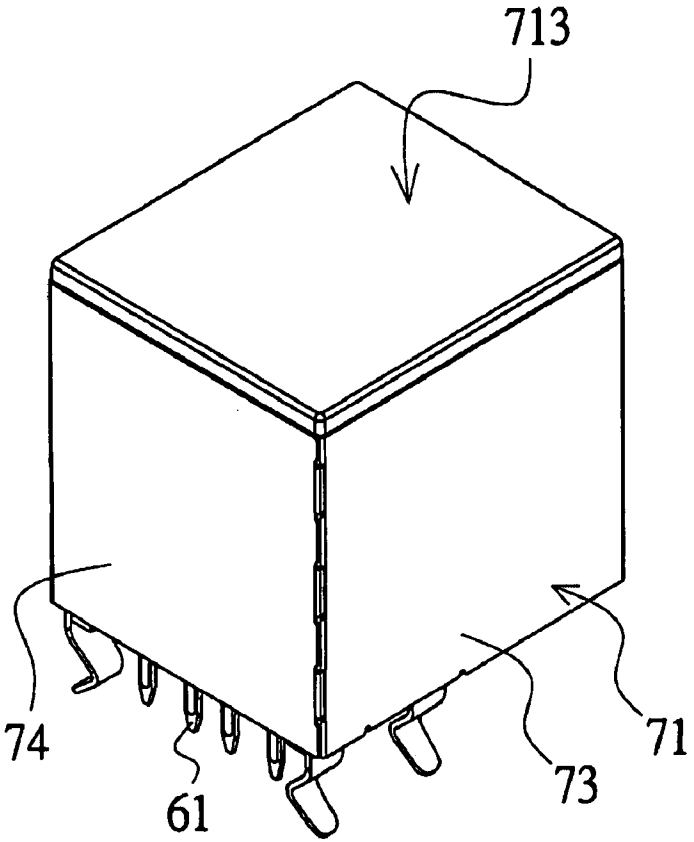
FIG. 6 is a pictorially assembled view showing the electrical connector according to the first embodiment of the invention.

Referring to FIGS. 5 and 6, an electrical connector of this embodiment is a dual-layer USB socket and includes a plastic base 50, terminals 60 and a metal housing 70.

Figure 7:
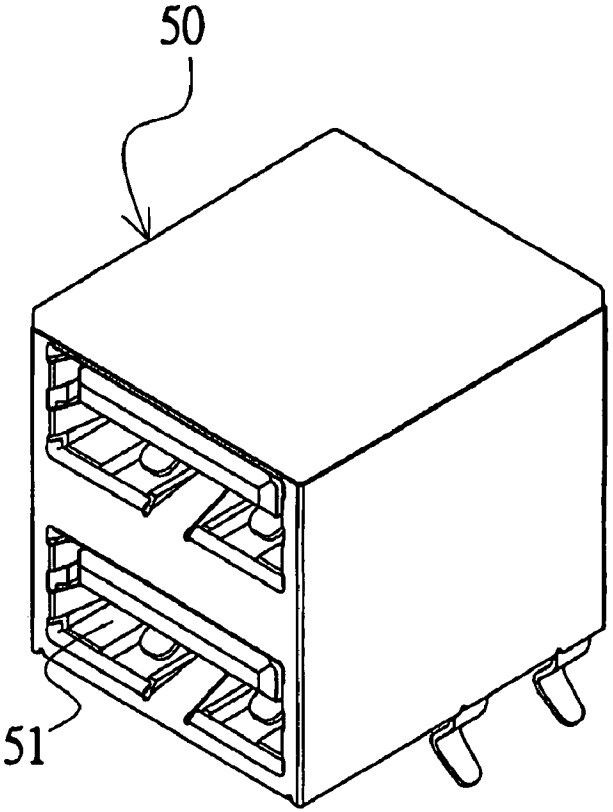
FIG. 7 is a pictorial front view showing a plastic base according to the first embodiment of the invention.

Referring to FIGS. 5 to 7, a front end of the plastic base 50 is formed with two connection slots 51 to be connected to USB plugs, and at least three engaging blocks 52 are formed on each of a rear surface and a side surface of the plastic base 50.

The terminals 60 are disposed in the plastic base 50. Each terminal 60 has a contact located in the connection slot 51 of the plastic base 50 and a pin 61 extending out of the plastic base 50.

Figure 8:
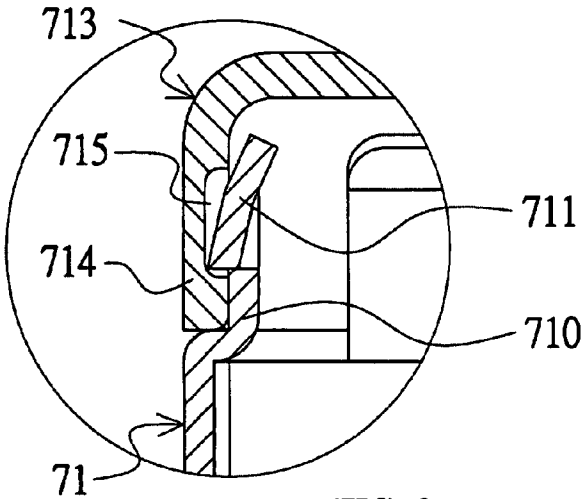
FIG. 8 is a cross-sectional assembled view showing a metal housing according to the first embodiment of the invention.

Referring to FIG. 8, the metal housing 70 made of stainless steel plate includes a main body 71 and an upper cover 713. The main body 71 includes a front surface 72, two side surfaces 73 and a rear surface 74 and is formed with a locking device. The locking device has a first engaging piece 75 and three second engaging pieces 76. The first engaging piece 75 is bent and located on an edge of the side surface 73. The second engaging piece 76 is bent and formed at the edge of the rear surface. The first engaging piece has three first engagement holes 77 and three longitudinal slots 78. The second engaging piece 76 is formed with a second engagement hole 79. In addition, the upper edge of each surface is formed with an upward fixing piece 710, which is formed with elastic locking pieces 711 that protrude upward and retract inward to form a step with each surface of the main body 71. The front surface 72 has two openings 712. When the metal housing 70 covers the plastic base 50, the plastic base 50 communicates with the outside through the two connection slots 51. The upper cover 713 and the main body 71 pertain to different parts. Four sides of the upper cover 713 are formed with downward connection flanges 714. An inner surface of the connection flange 714 corresponding to the elastic locking piece 711 of the fixing piece 710 of the main body is formed with an engaging slot 715, which is a concave slot. The upper cover 713 covers the upper edge of the main body 71. The connection flange 714 is connected to the fixing piece 710 and located outside the engaging slot 715, and locks with the elastic locking piece 711.

Figure 9:
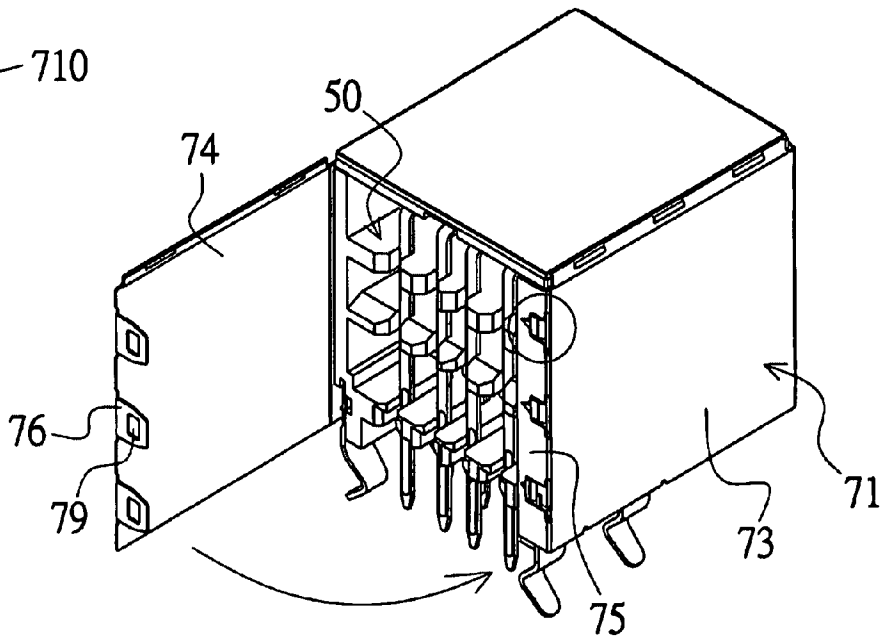
FIG. 9 is a schematic assembled illustration showing the electrical connector according to the first embodiment of the invention.
Figure 10:
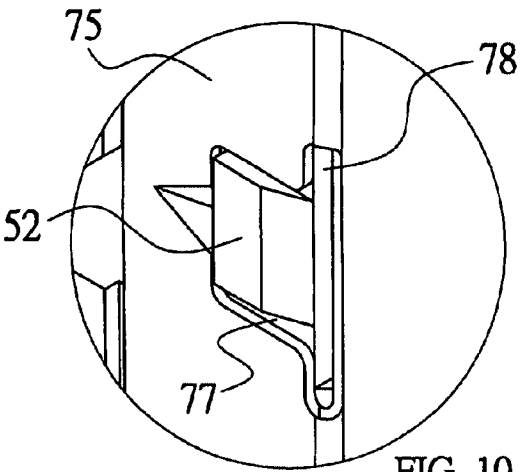
FIG. 10 is a pictorially assembled view showing a first engaging piece engaging with the plastic base according to the first embodiment of the invention.
Figure 11:
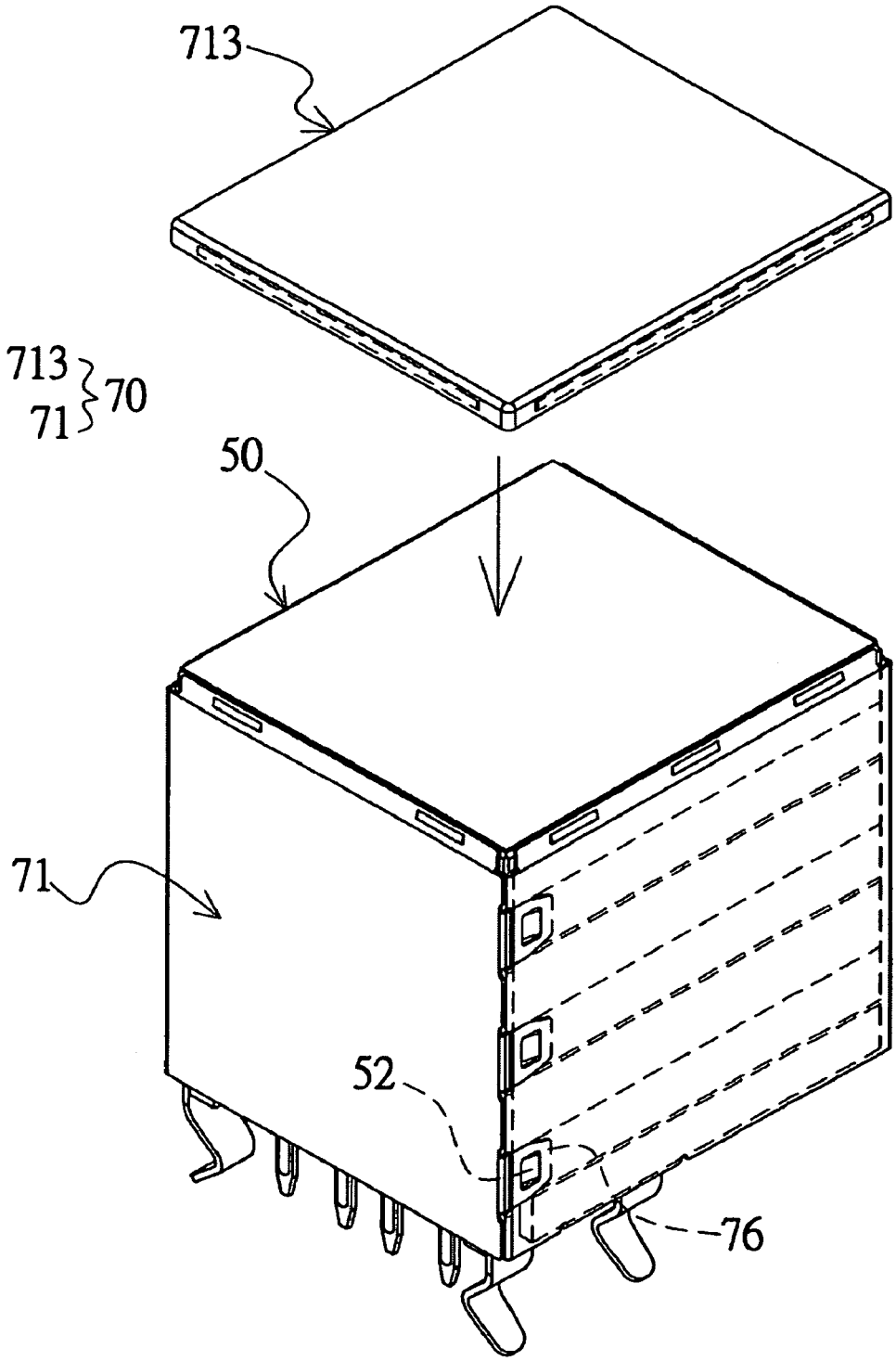
FIG. 11 is a schematic assembled illustration showing an electrical connector according to the first embodiment of the invention.

The assembling processes will be described in the following. As shown in FIGS. 9 and 10, the plastic base 50 is assembled in the main body 71 of the metal housing and the first engagement hole 77 of the first engaging piece 75 of the side surface 73 engages with the engaging block 52 on the rear surface of the plastic base 50. Then, as shown in FIG. 11, the second engaging piece 76 passes through the longitudinal slot 78 of the first engaging piece 75 and the second engagement hole 79 engages with the engaging block 52 on the side surface of the plastic base 50. Finally, the upper cover 713 covers the upper edge of the main body 71. The connection flange 714 is connected to the fixing piece 710 and engages with the elastic locking piece 711 through the engaging slot 715. As shown in FIGS. 6 and 8, because the fixing piece 710 retracts inward to form a step with each surface of the main body 71, the connection flange 714 can be flush with each surface of the main body 71 when the upper cover 713 covers the upper edge of the main body 71.

The invention has the following advantages.

First, the metal housing is divided into the main body 71 and the upper cover 713. After the upper cover 713 covers the main body 71, the plate surfaces thereof are flush with each other without overlapped folded edges such that the exterior may be glorified.

Second, the main body 71 includes circumferential surfaces including two side surfaces, one front surface and one rear surface. So, the developed main body is a simple rectangle. In addition, the upper cover 713 is also a simple rectangle. So, the wasted material being cut out during the manufacturing phase is very small, and the material can be greatly saved.

Third, the second engaging piece 76 passes through the longitudinal slot 78 of the first engaging piece 75. So, the first and second engaging pieces 75 and 76 may be shield by the rear surface 74 and the side surface 73 of the main body, such that the engaging portions can be hidden.

Figure 12:
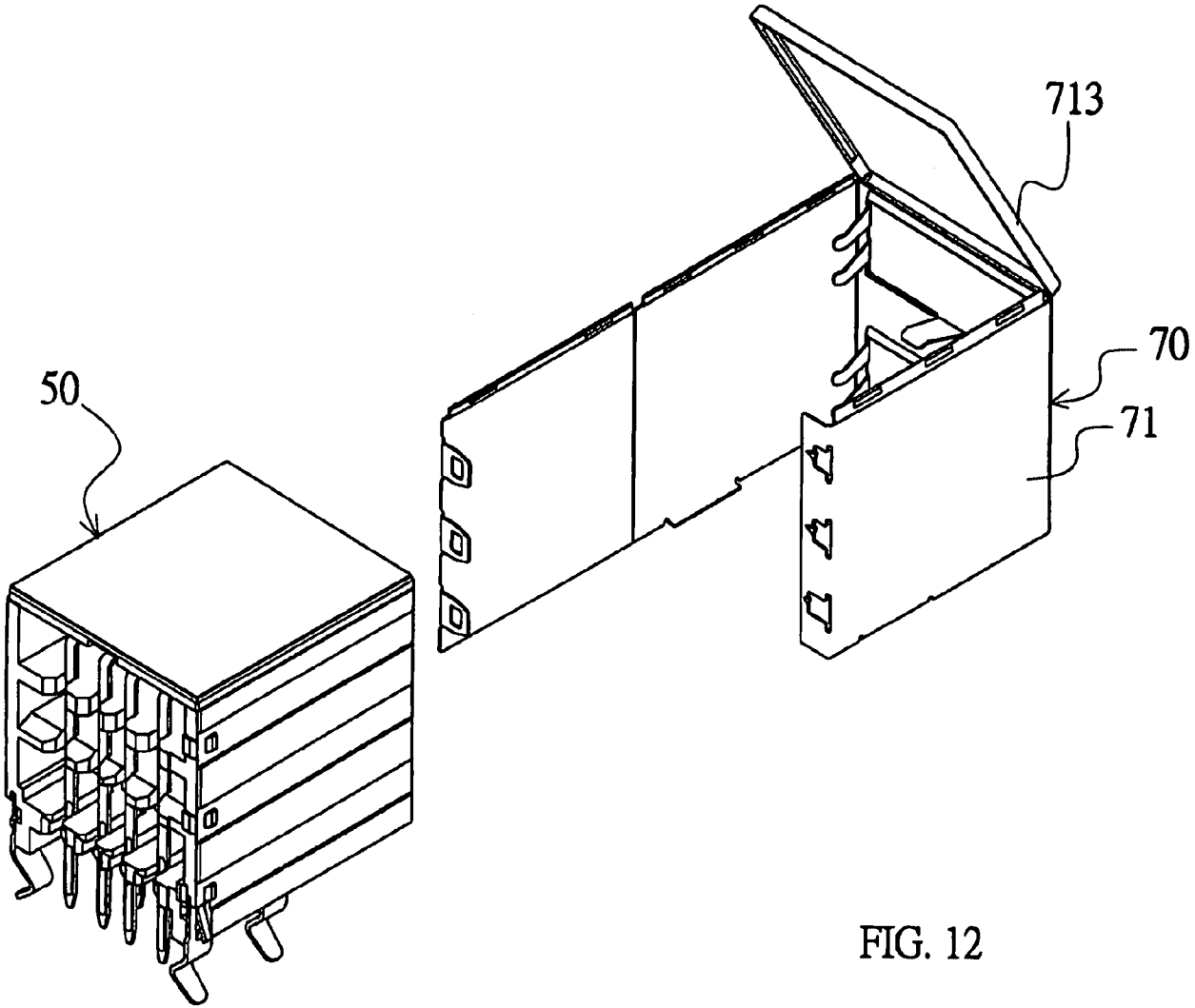
FIG. 12 is a pictorially exploded view showing an electrical connector according to a second embodiment of the invention.

As shown in FIG. 12, the second embodiment is almost the same as the first embodiment except that one side of the upper cover 713 of the metal housing 70 is integrally connected with the upper edge of the front surface of the main body 71.

Figure 13:
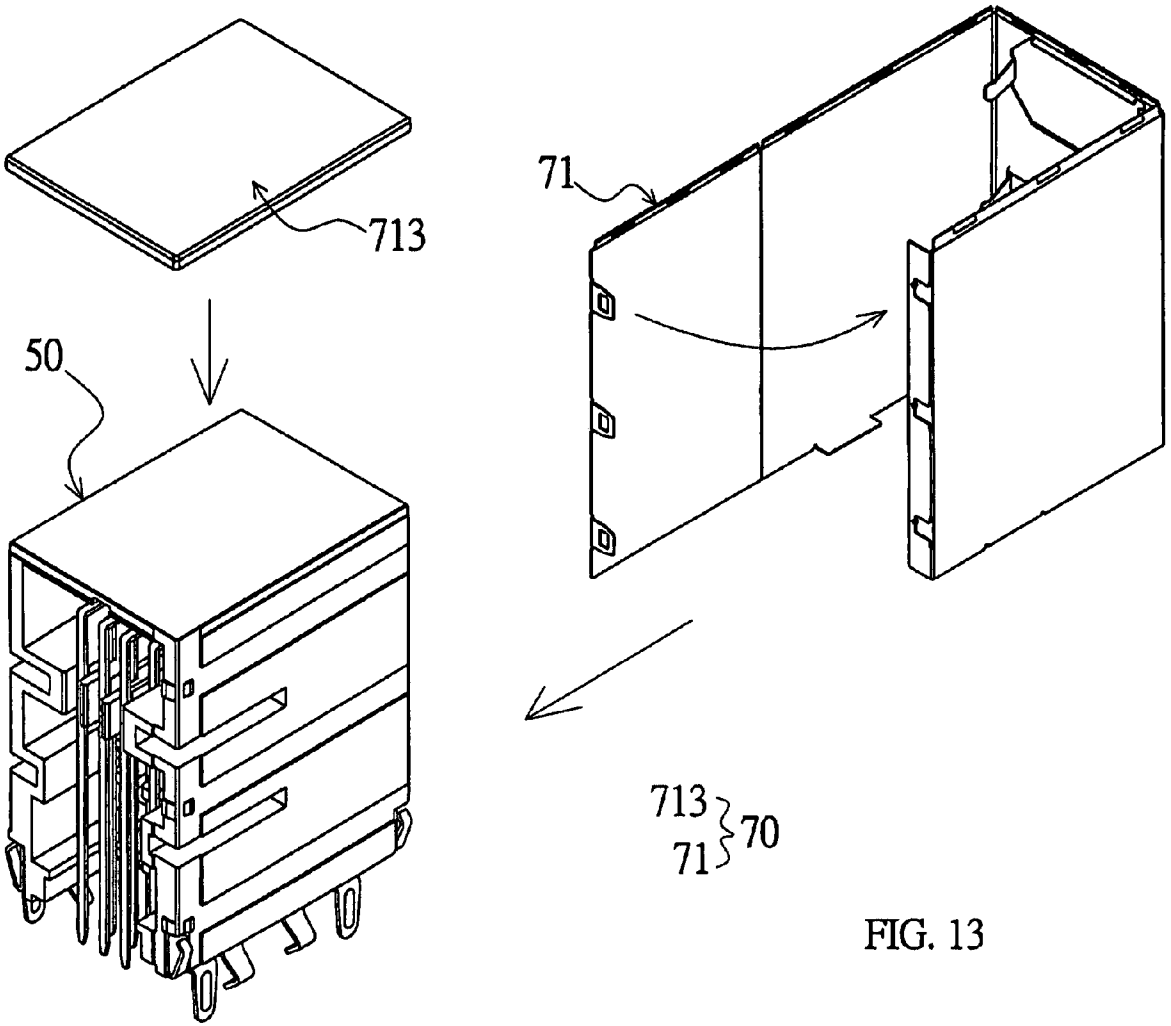
FIG. 13 is a pictorially exploded view showing an electrical connector according to a third embodiment of the invention.
Figure 14:
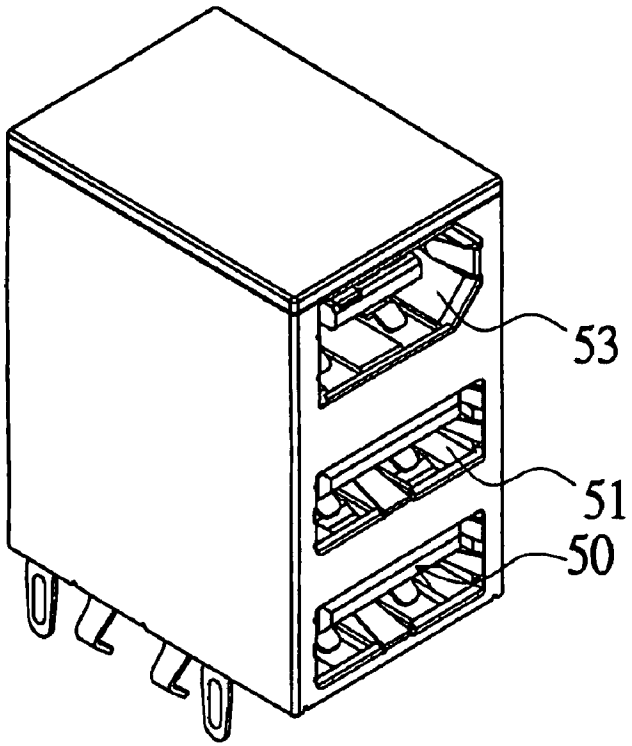
FIG. 14 is a pictorially assembled view showing the electrical connector according to the third embodiment of the invention.

As shown in FIGS. 13 and 14, the third embodiment is almost the same as the first embodiment except that the connector of the third embodiment is a dual-layer USB socket cooperating with a high speed serial bus (e.g., IEEE 1394) socket. That is, the plastic base 50 has two connection slots 51 for USB plugs and one connection slot 53 for the IEEE 1394 plug.

Figure 16:
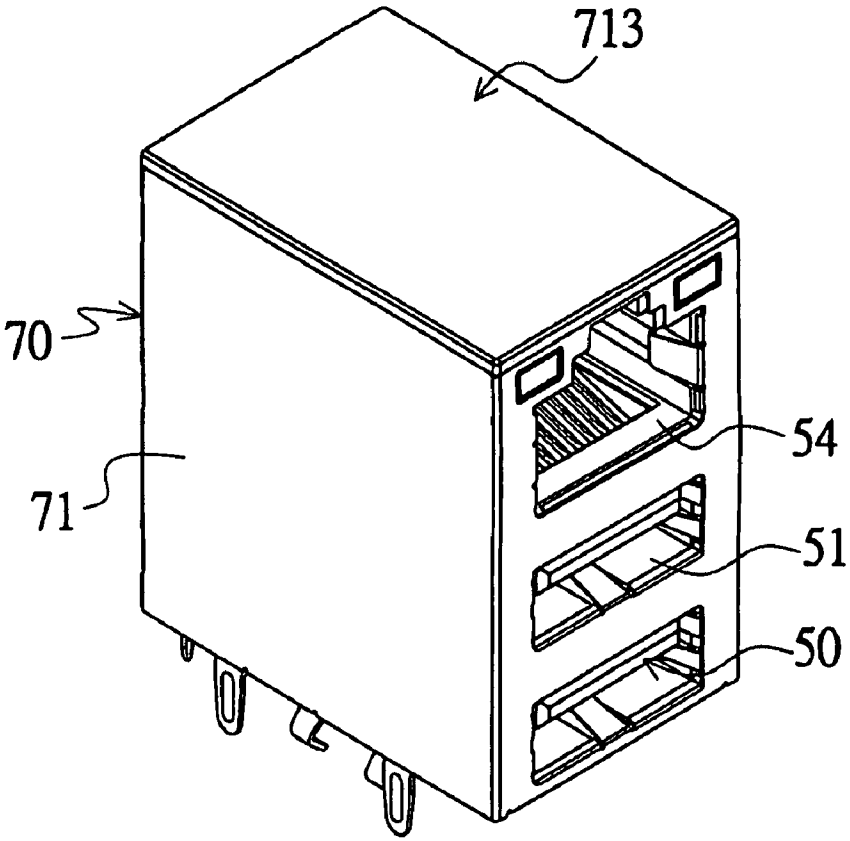
FIG. 16 is a pictorial view showing the electrical connector according to the fourth embodiment of the invention.
Figure 15:
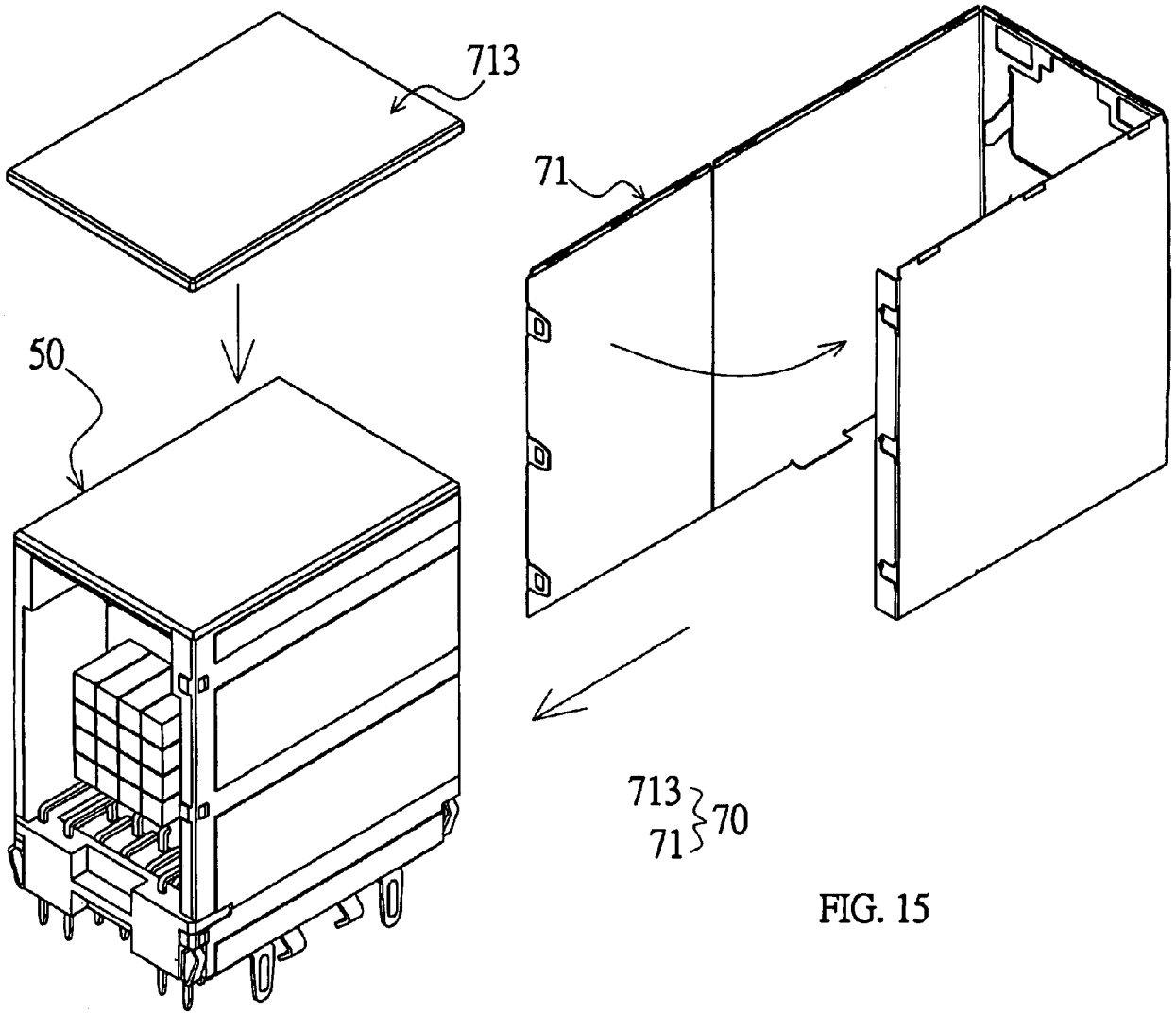
FIG. 15 is a pictorially exploded view showing an electrical connector according to a fourth embodiment of the invention.

As shown in FIGS. 15 and 16, the fourth embodiment is almost the same as the first embodiment except that the connector of this embodiment is a dual-layer USB socket cooperating with a network transmission (e.g., RJ45) socket. That is, the plastic base 50 has two connection slots 51 for USB plugs and one connection slot 54 for the RJ45 plug.

Figure 18:
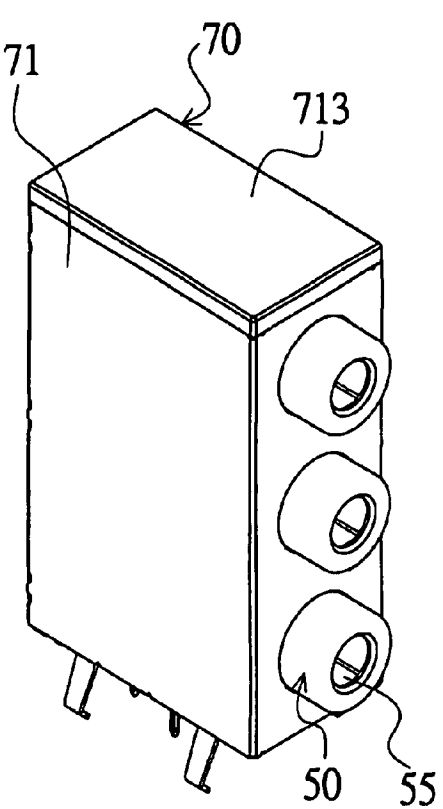
FIG. 18 is a pictorially assembled view showing the electrical connector according to the fifth embodiment of the invention.
Figure 17:
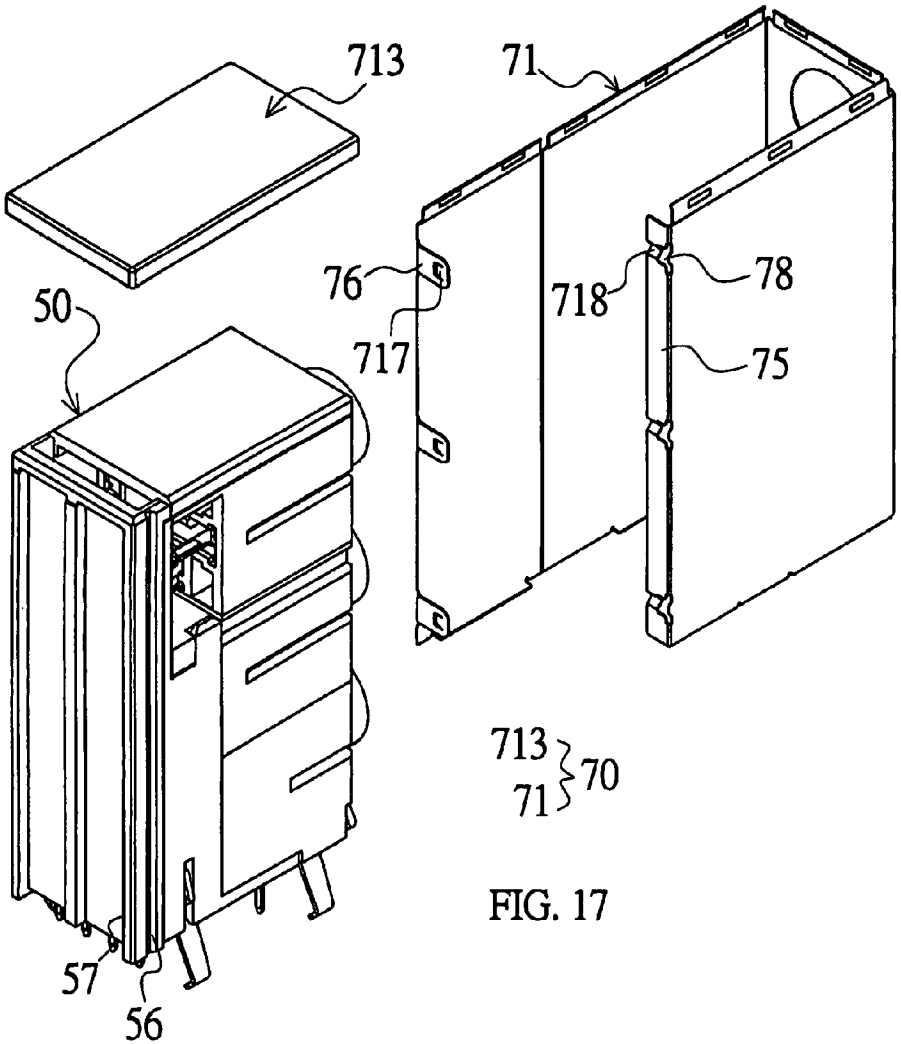
FIG. 17 is a pictorially exploded view showing an electrical connector according to a fifth embodiment of the invention.

As shown in FIGS. 17 and 18, the fifth embodiment is almost the same as the first embodiment except that the connector of the fifth embodiment is a multi-jack electrical connector. That is, the plastic base 50 has three connection holes 55 for earphone or microphone plugs at one side and concave slots 56 and 57 at the other side and the rear surface. The second engaging piece 76 of the metal housing 70 has an elastic locking piece 717. The first engaging piece 75 has three projections 718 projecting inward. During the assembling phase, the plastic base 50 is first mounted in the main body 71 of the metal housing, and the projection 718 of the first engaging piece 75 engages with the concave slot 57 on the rear surface of the plastic base 50. Next, the second engaging piece 76 passes through the longitudinal slot 78 of the first engaging piece 75, and the elastic locking piece 717 of the second engaging piece 76 can bounce to engage with the concave slot 56 on the side surface of the plastic base 50. Finally, the upper cover 713 covers the upper edge of the main body 71.

Figure 19:
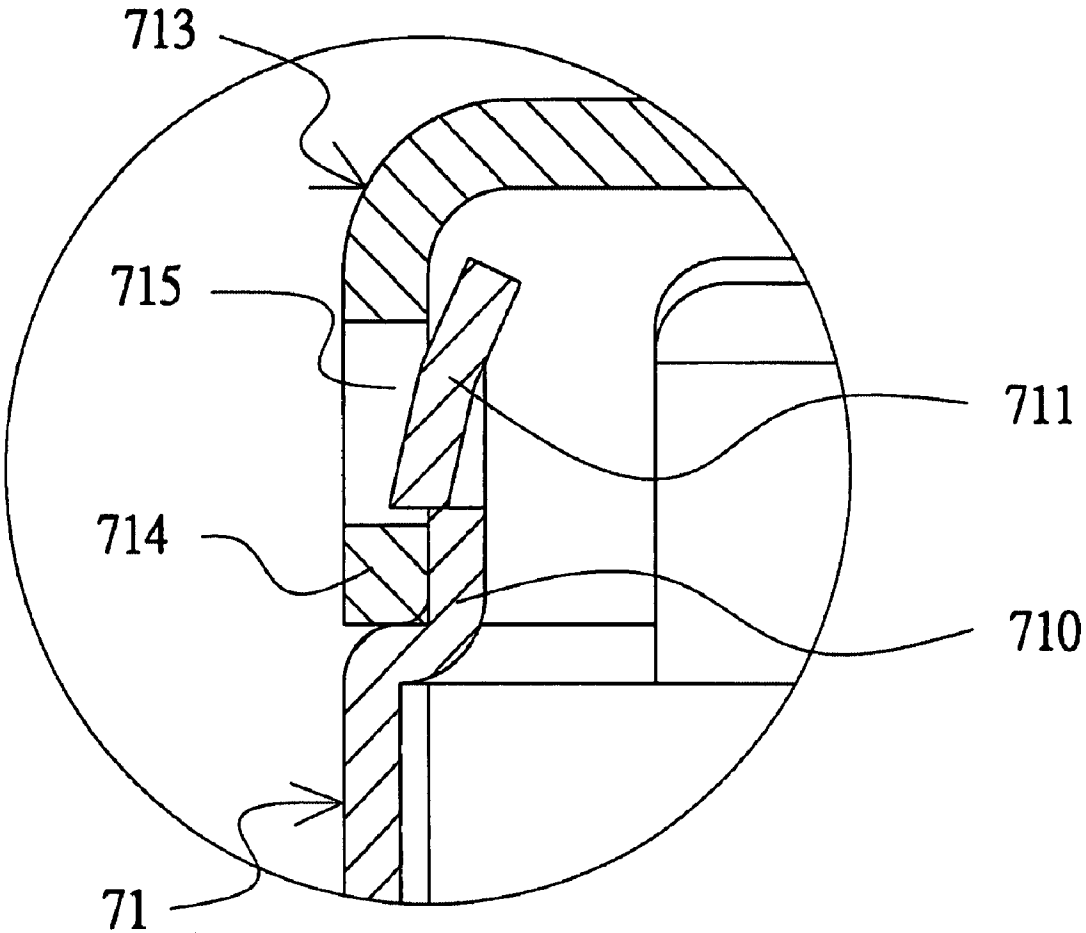
FIG. 19 is a cross-sectional assembled view showing an electrical connector according to a sixth embodiment of the invention.

As shown in FIG. 19, the sixth embodiment of the invention is almost the same as the first embodiment except that the engaging slot 715 of the upper cover 713 of the metal housing 70 in the connector of the sixth embodiment is a through hole.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electrical connector, comprising:

a plastic base on which at least one connection space is formed;

a plurality of terminals disposed in the plastic base, each of the terminals having a pin portion extending out of the plastic base; and a metal housing, which covers the plastic base and has one surface formed with an opening through which the at least one connection space of the plastic base is exposed, wherein the metal housing comprises:

a main body, which is fixed to the plastic base and has a front surface, two side surfaces and an upper edge formed with at least one upward fixing piece having at least one elastic locking piece; and an upper cover having downward connection flanges formed on at least two sides, wherein an inner surface of each of the connection flanges corresponding to the at least one elastic locking piece of the at least one upward fixing piece of the main body is formed with an engaging slot, the upper cover covers the upper edge of the main body, and the connection flanges are connected to the at least one upward fixing piece and located outside the at least one upward fixing piece, and engage with the at least one elastic locking piece through the engaging slot.

2. The connector according to claim 1, wherein the main body and the upper cover pertain to different parts.

3. The connector according to claim 2, wherein the main body of the metal housing further has a rear surface, and the upper cover has four sides formed with the downward connection flanges.

4. The connector according to claim 1, wherein one side of the upper cover of the metal housing is integrally connected with an upper edge of one surface of the main body.

5. The connector according to claim 1, wherein the at least one upward fixing piece of the main body of the metal housing slightly retracts inward to form a step with each of four surfaces of the main body, and the downward connection flanges may be flush with each of the surfaces of the main body when the upper cover covers the main body.

6. The connector according to claim 1, wherein the main body of the metal housing is formed with a locking device, the locking device comprises a first engaging piece and a second engaging piece corresponding to the first engaging piece, the first engaging piece is formed with one longitudinal slot, and the second engaging piece passes through the longitudinal slot of the first engaging piece.

7. The connector according to claim 6, wherein:

at least one engaging block is formed on each of a rear surface and a side surface of the plastic base;

the first engaging piece is formed with at least one first engagement hole engaging with the at least one engaging block on one of the rear surface and the side surface of the plastic base; and the second engaging piece is formed with at least one second engagement hole engaging with the at least one engaging block on the other of the rear surface and the side surface of the plastic base.

8. The connector according to claim 7, wherein the first engaging piece is bent and formed on an edge of a side surface of the metal housing, and the second engaging piece is bent and formed on an edge of a rear surface of the metal housing.

9. The connector according to claim 6, wherein:

three engaging blocks are formed on each of a rear surface and a side surface of the plastic base;

the locking device comprises a first engaging piece and three second engaging pieces, the first engaging piece is formed with three first engagement holes and three longitudinal slots, through which the three second engaging pieces pass respectively.

10. The connector according to claim 6, wherein at least one concave slot is formed on each of a rear surface and a side surface of the plastic base;

the first engaging piece is formed with at least one inward projection engaging with the at least one concave slot on one of the rear surface and the side surface of the plastic base; and the second engaging piece is formed with at least one elastic locking piece engaging with the at least one concave slot on the other of the rear surface and the side surface of the plastic base.

11. The connector according to claim 1, wherein the engaging slot of the metal housing is a concave slot.

12. The connector according to claim 1, wherein the engaging slot of the metal housing is a through hole.

* * * * *